United States Patent [19]

Stunzi et al.

[11] Patent Number: 4,782,197

[45] Date of Patent: Nov. 1, 1988

[54] ELECTRICAL BUSHING HAVING A REPLACEABLE STUD

[75] Inventors: Joseph M. Stunzi; Donald J. Ristuccia, both of Athens, Ga.

[73] Assignee: Westinghouse Electric Corp., Pittsburgh, Pa.

[21] Appl. No.: 171,080

[22] Filed: Mar. 21, 1988

[51] Int. Cl.[4] ..... H01B 17/26; H01R 13/207

[52] U.S. Cl. ..... 174/152 R; 439/544; 439/921

[58] Field of Search ..... 174/152 R, 152 S, 153 R; 439/544, 559, 562, 564, 921

[56] References Cited

U.S. PATENT DOCUMENTS 2,012,699 8/1935 Walters ..... 174/152 S X 3,622,946 11/1971 Rogers ..... 439/921 X 4,353,611 10/1982 Siebens et al. ..... 439/921 X 4,611,093 9/1986 Farmer et al. ..... 174/152 R

*Primary Examiner*—Laramie E. Askin

*Attorney, Agent, or Firm*—B. R. Studebaker

[57] ABSTRACT

An electrical bushing for use in connection with an electrical apparatus which includes a replaceable stud connector. The replaceable stud has a pair of axially aligned threaded shanks on each side of a flange. The flange on the replaceable stud engages a flange on an electrical conductor in the bushing when one of the threaded shanks of the replaceable stud is threaded into a threaded bore in the electrical conductor, whereby any breakage of the replaceable stud will tend to occur in the other threaded shank.

10 Claims, 1 Drawing Sheet

ELECTRICAL BUSHING HAVING A REPLACEABLE STUD

This invention relates to electrical bushings for use in connection with electrical distribution equipment and more particularly to an electrical bushing having a replaceable stud for interconnecting the electrical bushing with an external electrical connector.

Electrical bushings are generally employed with electrical distribution equipment to connect the high voltage service to a transformer or the like. Conventionally, bushing wells are constructed with an integral threaded stud which extends from the open end of the bushing through the electrical distribution apparatus wall and terminates in an electrical connection within the electrical distribution apparatus housing. A threaded connector was normally employed on the electrical conductor that was adapted to be threaded into a female electrical connector external of the transformer or the like.

A problem with this type of bushing connection occurred when the external electrical connector was threaded too tightly onto the electrical conductor causing the threaded stud to break which then required that the entire bushing be removed from the transformer housing and replaced.

U.S. Pat. No. 4,353,611 to Siebens et al. for Bushing Well Stud Construction addresses this problem by employing a threaded coupling member in which a portion of the coupling member is threaded into the electrical conductor of the bushing well and the other end has a threaded portion for receiving the external electrical connector. One approach was to provide a wrenching configuration which included a hollow stud having a hexagonal cross section which would provide for the removal of the coupling member if it should break. Alternatively, there was suggested that an external collar could be provided on the coupling member to provide the wrenching function thereto. In this configuration it was necessary to provide an annular notch in the coupler to serve as a sheer locating means to assure that excessive torque applied on the coupling member would tend to sheer the pin in a particular location.

U.S. Pat. No. 4,611,093 to Farmer et al. for Electrical Bushing Having A Replaceable Stud also addressed this problem and employed a threaded stud having an intermediate collar. In this configuration the shank portion of the stud not threaded into the bushing conductor was made of a smaller diameter in order to insure that breakage would occur on the outside of the central flange portion so that the internal portion could then be removed from the electrical conductor by means of the flange and replaced. Having a connector or coupler which is hollow and includes a hexagonal aperture extending entirely through the connector provides for a weakened connector linkage as does providing a notch which encourages breakage of the stud by providing a weakened location. Employing an enlarged shank portion to thread into the electrical conductor requires a larger conductor diameter and significantly reduces the sidewall area of the boss surrounding the conductor and tends to weaken that portion of the molded bushing well. In addition, reducing the external threaded shank portion to encourage breakage on that side of the flange tends to fulfill that requirement and undesirably encourage breakage.

SUMMARY OF THE INVENTION

In order to obviate the inherent disadvantages of the prior art replaceable studs there has been provided an electrical bushing for use in connection with an electrical apparatus which has a replaceable connecting member for interconnecting the electrical bushing with an external electrical connector. The bushing includes a molded body portion having sidewalls and an end wall defining an electrical connector receiving cavity. The end wall includes a reentrant boss extending into the cavity and terminating in a shoulder portion with a central aperture interconnecting the shoulder portion and the outer surface of the end wall which is located within the electrical distribution apparatus. An electrical conductor is molded within the central aperture and has a laterally extending flange on one end and electrical connecting means on the other end, the laterally extending flange overlies the shoulder portion of the reentrant boss and a threaded bore is provided in the flanged end of the electrical conductor. A replaceable stud having a pair of axially aligned threaded shank portions and a central flange portion extending normal to the axially aligned threaded shank portions has one shank portion threaded into the threaded bore to an extent that the central flange portion on the replaceable stud is in frictional engagement with the laterally extending flange on the electrical conductor. The central flange portion of the replaceable stud includes means for facilitating the rotation of the replaceable stud and may take the form of a pair of apertures extending through the flange portion or the flange portion can have a hexagonal periphery. The threaded shank portion of the replaceable stud threaded into the threaded bore in the electrical connector may be of a smaller diameter than the external threaded shank portion; and the threaded shank portion threaded into the electrical conductor is of a shorter length than the threaded bore in the electrical conductor.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
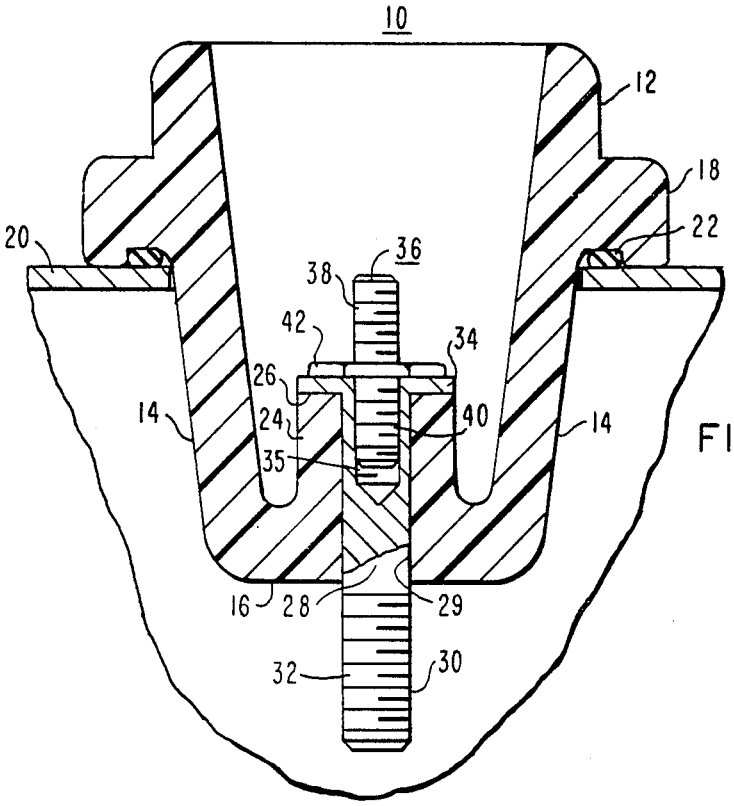
FIG. 1 is a sectional view of an electrical bushing embodying the present invention.
Figure 3:
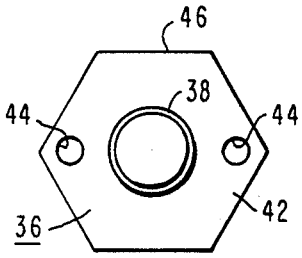
FIG. 3 is a top plan view of the replaceable stud illustrated in both FIGS. 1 and 2.

Referring now in detail to the drawings wherein the like reference characters represent like parts throughout the several views there is illustrated in FIG. 1 the electrical bushing well generally designated 10 which includes a cylindrical cup-shaped bushing body 12 having sidewalls 14 and an end wall 16 defining a bushing cavity. The unitary bushing body 12 has a radially extending flange 18 thereabout to facilitate sealing the bushing well to an electrical distribution apparatus housing 20 as for example a transformer. The bushing well, through the radially extending flange 18, can be suitably connected to the transformer housing 20 by conventional clamping or welded ring mechanisms (not shown) and may be sealed thereto by an O-ring seal, as for example O-ring 22.

The bushing body 12 includes a reentrant boss 24 in the end wall 16 which extends into the cavity defined by the side walls 14 and terminates in boss shoulder portion 26. An electrical conductor 28 is molded into an aperture 29 which extends from the shoulder portion 26 of the boss 24 through the end wall 16 and is preferably axially aligned with the cavity. The conductor 28 includes means 30 extending exteriorly of the bushing well and into the transformer body for connecting the conductor to the electrical distribution in apparatus within the housing 20, as for example a transformer core coil assembly. This electrical connecting means may take the form of threads 32 or other suitable connection configurations. At the other end of the elecrical conductor 28 is a radially extending flange 34 which almost completely overlies the shoulder portion 26 of the boss 24 and includes in that end of the conductor 28 a centrally disposed threaded bore 35. Preferably, the entire electrical conductor is of copper alloy construction.

The replaceable stud 36 of this invention includes first and second axially aligned threaded shanks or end portions 38 and 40 and a central flange portion 42 which extends laterally of the axially aligned shank portions and is preferably approximately the same diameter as the radial flange 34 on the electrical conductor 28. The replaceable stud 36 is also, preferably, constructed entirely of a copper alloy.

In the embodiment of FIG. 1 the threaded shank portions 38 and 40 are both of the same diameter and include the same thread pitch so that the replaceable stud can be threaded into the threaded bore 35 in the electrical conductor interchangeably. The radial flange may be provided with one or more means by which the replaceable stud can be rotated to either remove from or mount the stud with respect to the electrical conductor 28. For example, the flange 42 can be provided with apertures 44 therethrough for receiving a suitable tool to impart rotation to the replaceable stud or the flange 42 may have a hexagonal or other multiple sided configuration on its edges as at 46 to receive an appropriate wrench or the like for providing rotation to the stud.

The replaceable stud of this invention has several unique features not heretofore associated with replaceable stud constructions. When the threaded shank 40 is threaded into the threaded bore 35, it is seated to a point where the flange 42 frictionally engages the flange 34 thereby preventing any torque or bending moment applied to the stud when the external electrical connector is connected thereto from being transmitted to the threaded shank 40 so that any breakage will necessarily be imparted to the threaded shank 38. Additionally, the interfacing of the two copper alloy flanges 42 and 34 provides for good electrical conductivity between the replaceable stud and the electrical conductor, thereby eliminating the need to rely on only the threaded connection for electrical contact.

Figure 2:
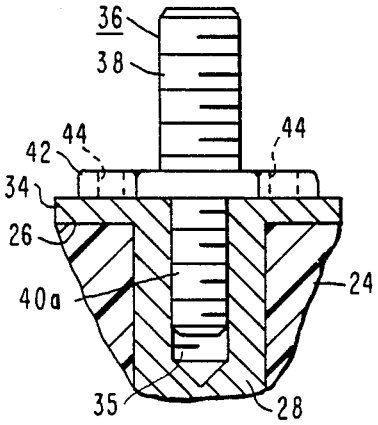
FIG. 2 is a side elevation view of an alternative construction for the replaceable stud of this invention.

As illustrated in FIG. 2, the shank 40*a* which is threaded into the electrical conductor 28 can be of a significantly lesser diameter than the threaded shank 38 since the interaction of the two copper alloy flanges 42 and 34 will prevent the torque or bending moment from being imparted to the end portion 40*a* of the replaceable stud. The advantage of utilizing the smaller threaded shank 40*a* permits the conductor to be of a smaller diameter and, hence, the side walls surrounding the conductor to be of significantly thicker dimension which prevents the degradation of mechanical strength in this molded area.

It should be noted that the threaded bore 35 in the electrical conductor 28 is of a significantly greater length than that of the threaded shanks 40 or 40*a*, thus preventing the threaded shanks from bottoming out at the bottom of the bore and providing an undesirable locking of the threaded stud within the threaded bore. Furthermore, this construction assures that the flange 42 will frictionally engage to flange 34 since the interaction of the radial flange 42 frictionally engaging the flange 34 on the electrical conductor prevents the threaded shank 40 from entering the threaded bore beyond a preselected depth.

As will be apparent from the foregoing, the replaceable stud of this invention has considerable and distinct advantages over replaceable studs heretofore available in that any inadvertent breakage will occur in the threaded shank portion 38 without having, for any reason, intentionally weakened that portion of the replaceable stud. Furthermore, the interaction of the radial flanges 42 and 34 improves the electrical conductivity of the replaceable stud-electrical conductor interface and the replaceable stud can either be interchangeably utilized with respect to the electrical conductor without regard to orientation, as in the FIG. 1 embodiment, or can be provided with a threaded shank of significantly smaller diameter to provide for improved side wall strength in the reentrant base surrounding the reduced diameter electrical conductor.

What is claimed is:

1. An electrical bushing for use with an electrical apparatus, said electrical bushing comprising:

a molded bushing body having an internal cavity, said internal cavity being open at one end of said bushing body and closed off at the other end of said bushing body by an end wall having a reentrant boss including a shoulder portion thereon surrounding an axial opening in said end wall communicating with said cavity;

a flanged conductor molded in said axial opening, said flanged conductor having a radially extending flange on one end thereof overlying said shoulder portion on said reentrant boss, and electrical connection means at the other end thereof, said flanged conductor having a threaded bore in said flanged end;

a replaceable stud for connecting the electrical apparatus to an external electrical connector, said replaceable stud including a pair of threaded end portions and a central flange portion including means for facilitating the rotation of said replaceable stud, said replaceable stud having one end threaded into said threaded bore to seat said central flange portion on said radially extending flange on said flanged conductor.

2. The electrical bushing according to claim 1 wherein said threaded end portion of said replaceable stud threaded into said threaded bore is of a smaller diameter than the other threaded end portion.

3. The electrical bushing according to claim 1 wherein said means for facilitating the rotation of said replaceable stud is a plurality of flat edges on said central flange portion.

4. The electrical bushing according to claim 1 wherein said means for facilitating the rotation of said replaceable stud is at least two apertures extending through said central flange portion.

5. An electrical bushing for use in connection with an electrical apparatus and having a replaceable connecting member, said electrical bushing comprising;

a molding body portion having side walls and an end wall defining an electrical connector receiving cavity, said end wall including a reentrant boss extending into said cavity terminating in a shoulder portion and a central aperture communicating between said shoulder portion and the outer surface of said end wall;

an electrical conductor molded within said central aperture having a laterally extending flange on one end and electrical connecting means on the other end, said laterally extending flange overlying said shoulder portion of said reentrant boss and a threaded bore in said flanged end of said electrical conductor;

a replaceable stud having a pair of axially aligned threaded shank portions and a central flange portion extending normal to said axially aligned threaded shank portions, one of said shank portions being threaded into said threaded bore to an extent that said central flange portion on said replaceable stud is in frictional engagement with said laterally extending flange on said electrical conductor.

6. The electrical bushing according to claim 5 wherein said central flange portion of said replaceable stud includes means for facilitating the rotation of said replaceable stud.

7. The replaceable bushing according to claim 6 wherein said means for facilitating the rotation of said replaceable stud is at least two apertures extending through said central flange portion.

8. The electrical bushing according to claim 6 wherein said means for facilitating the rotation of said replaceable stud is a plurality of flat side edges on said central flange portion.

9. The electrical bushing according to claim 5 wherein said threaded shank portion of said replaceable stud threaded into said threaded bore is of a smaller diameter than the other threaded shank portion of said replaceable stud.

10. The electrical bushing according to claim 5 wherein said threaded bore is of greater length than either of said threaded shank portions.

* * * * *